US007475579B2

(12) United States Patent
Miao

(10) Patent No.: US 7,475,579 B2
(45) Date of Patent: Jan. 13, 2009

(54) LOCK WITH A LIMITING SLIDE ASSEMBLY

(75) Inventor: Tony Miao, Taipei Hsien (TW)

(73) Assignee: Jin Tay Industries Co., Ltd., Taipei Hsien (TW)

( * ) Notice: Subject to any disclaimer, the term of this patent is extended or adjusted under 35 U.S.C. 154(b) by 230 days.

(21) Appl. No.: 11/349,001

(22) Filed: Feb. 7, 2006

(65) Prior Publication Data

US 2007/0209415 A1 Sep. 13, 2007

(51) Int. Cl.
*E05B 27/00* (2006.01)
*E05B 29/00* (2006.01)

(52) U.S. Cl. ..... 70/496; 70/360; 70/419; 70/490

(58) Field of Classification Search ..... 70/358, 70/360–361, 496, 490–491, 419
See application file for complete search history.

(56) References Cited

U.S. PATENT DOCUMENTS 3,756,049 A * 9/1973 Kerr ..... 70/491
4,012,931 A * 3/1977 Harunari ..... 70/496
5,133,203 A 7/1992 Huang ..... 70/360
5,447,049 A * 9/1995 Shieh ..... 70/491
5,720,191 A * 2/1998 Tsung-Chuan et al. ..... 70/491
5,921,118 A * 7/1999 Yuan ..... 70/491
6,718,808 B2 * 4/2004 Yu ..... 70/491
6,904,775 B2 * 6/2005 Makos et al. ..... 70/491
7,171,833 B1 * 2/2007 Wu ..... 70/491
2006/0096344 A1 * 5/2006 Lee ..... 70/491

* cited by examiner

*Primary Examiner*—Patricia L Engle
*Assistant Examiner*—Christopher Boswell
(74) *Attorney, Agent, or Firm*—Alan Kamrath; Kamrath & Associates PA

(57) ABSTRACT

A lock has a housing, a movable cylinder, a stationary cylinder, a limiting slide assembly and a latch bar. The housing has a cavity. The movable cylinder is mounted rotatably in the cavity and has a curved recess. The stationary cylinder is mounted securely in the cavity and adjacent to the movable cylinder and has a rail slot. The limiting slide assembly is mounted in the rail slot and has a limiting slide, a ball and a spring. The limiting slide is mounted slidably in the rail slot and has a ball recess for receiving the ball. The latch bar extends through the movable and stationary cylinders and has an annular groove for receiving the ball. The limiting slide assembly is compact and has a simple structure to improve the production rate and the lower the cost of the lock.

5 Claims, 9 Drawing Sheets

LOCK WITH A LIMITING SLIDE ASSEMBLY

BACKGROUND OF THE INVENTION

1. Field of the Invention

The present invention relates to a lock and more particularly to a lock that includes a limiting slide assembly with a simple structure and which is easily fabricated to improve the production rate and lower the cost of the lock.

2. Description of Related Art

Locks are usually used with articles such as doors, cabinets, showcases and safes for a purpose that prevents any unauthorized accesses to these articles.

A conventional lock disclosed in U.S. Pat. No. 5,133,203 is made for the aforementioned purpose but has a complicated structure and difficult fabrication with heavy efforts and time, which result in a low production rate and a high cost.

To overcome the shortcomings, the present invention provides a lock with a limiting slide assembly to mitigate or obviate the aforementioned problems.

SUMMARY OF THE INVENTION

The main objective of the invention is to provide a lock that includes a limiting slide assembly having a simple structure and which is easily fabricated to improve the production rate and lower the cost of the lock.

A lock in accordance with the present invention comprises a housing, a movable cylinder, a stationary cylinder, a limiting slide assembly and a latch bar.

The housing has a cavity.

The movable cylinder is mounted rotatably in the cavity and has a curved recess.

The stationary cylinder is mounted securely in the cavity and adjacent to the movable cylinder and has a rail slot.

The limiting slide assembly is mounted in the rail slot and has a limiting slide, a ball and a spring the limiting slide is mounted slidably in the rail slot and has a ball recess for receiving the ball.

The latch bar extends through the movable and stationary cylinders and has an annular groove for receiving the ball.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
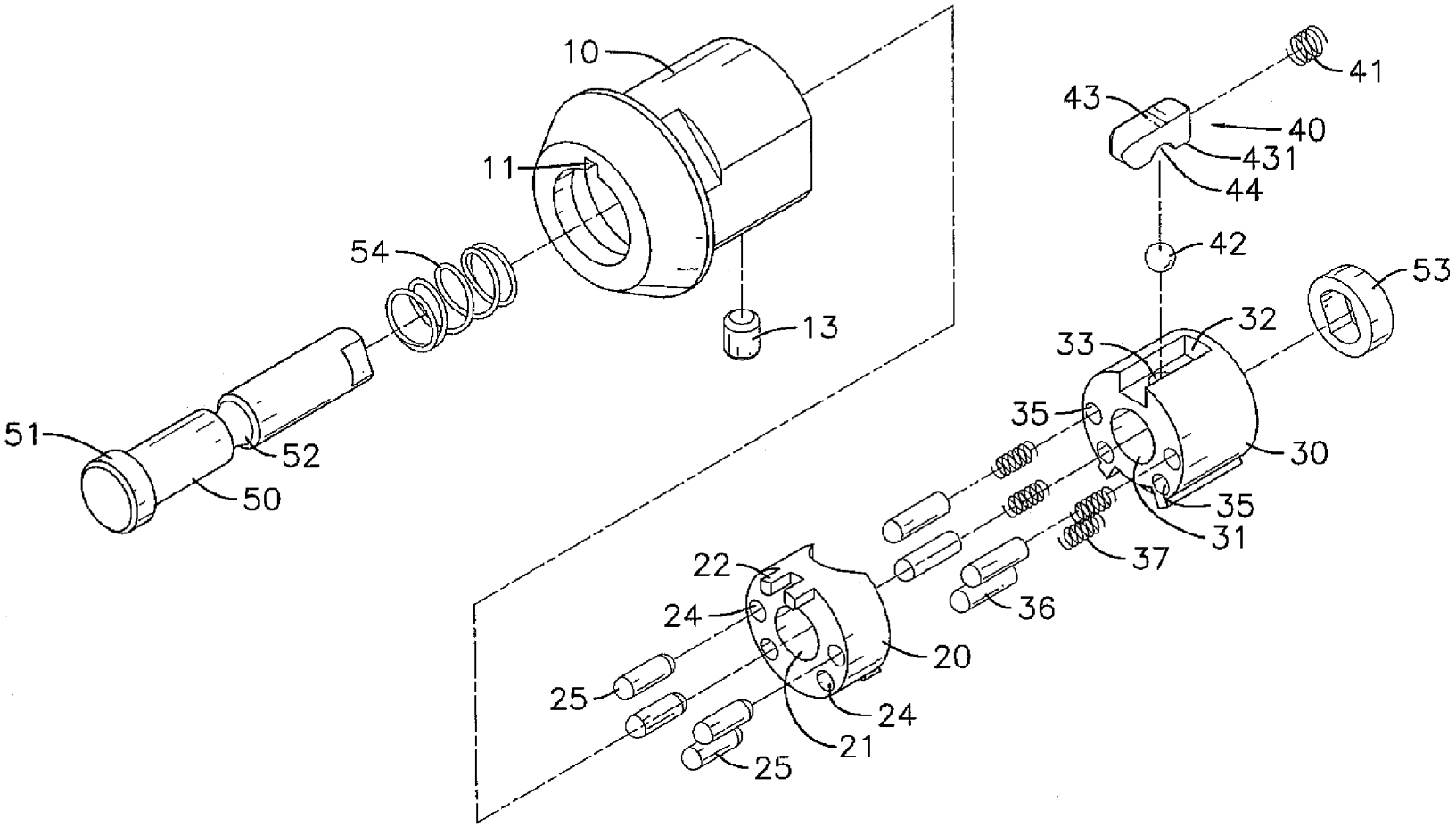
FIG. 1 is an exploded perspective view of a first embodiment of a lock in accordance with the present invention.
Figure 2:
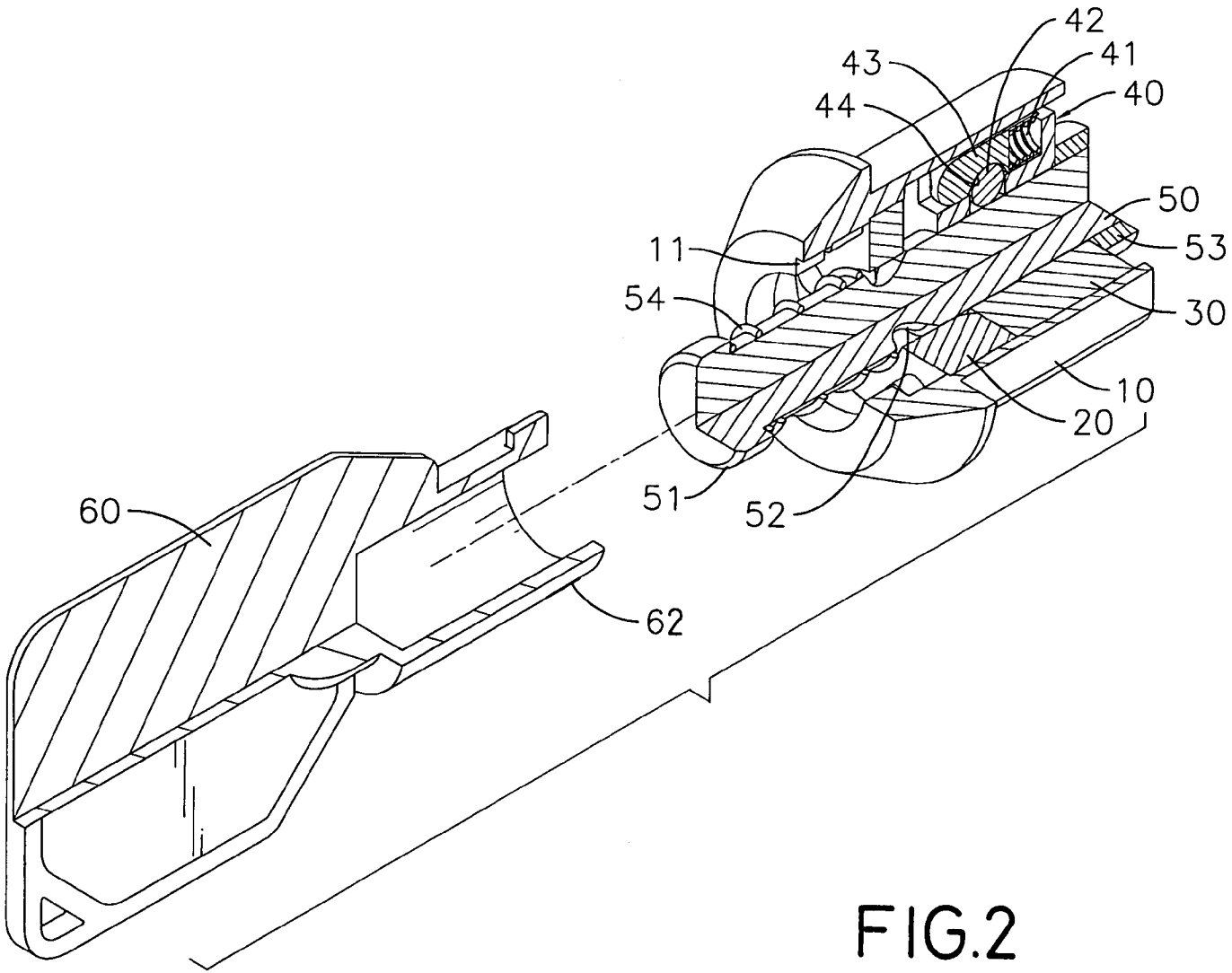
FIG. 2 is an exploded cross sectional perspective view of the lock in FIG. 1 with the key.
Figure 3:
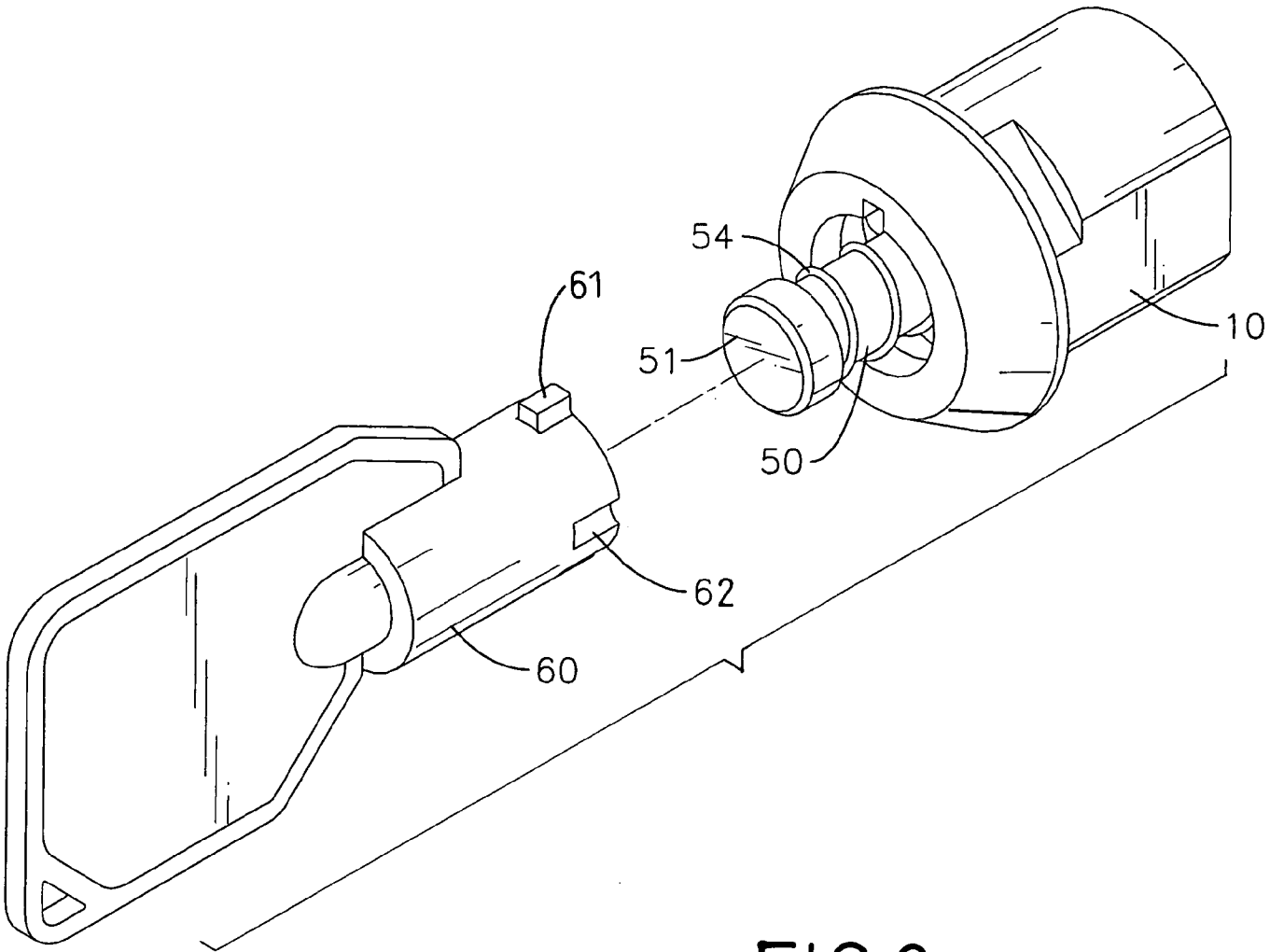
FIG. 3 is an exploded perspective view of the lock and key in FIG. 2.

With reference to FIGS. 1 to 3, a lock in accordance with the present invention is used with a key (60). The key (60) has a handle and a sleeve. The sleeve extends from the handle and has an alignment projection (61) and multiple tumbler recesses (62) defined in the sleeve.

The lock is switched between a locked configuration and a unlocked configuration and comprises a housing (10), a movable cylinder (20), a stationary cylinder (30), a limiting slide assembly (40) and a latch bar (50).

Figure 4:
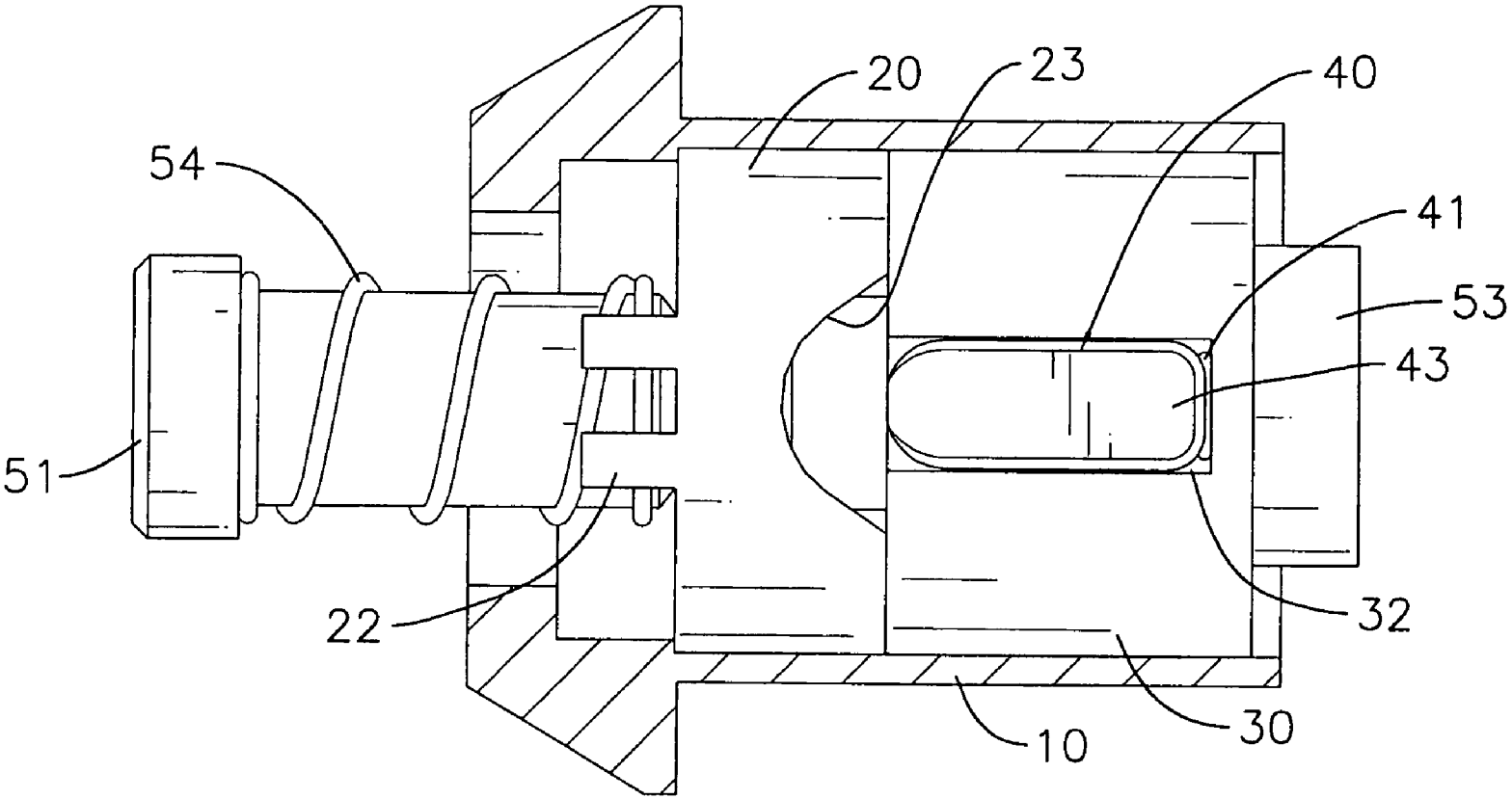
FIG. 4 is a top view in partial section of the lock in FIG. 3 in an unlocked configuration.
Figure 5:
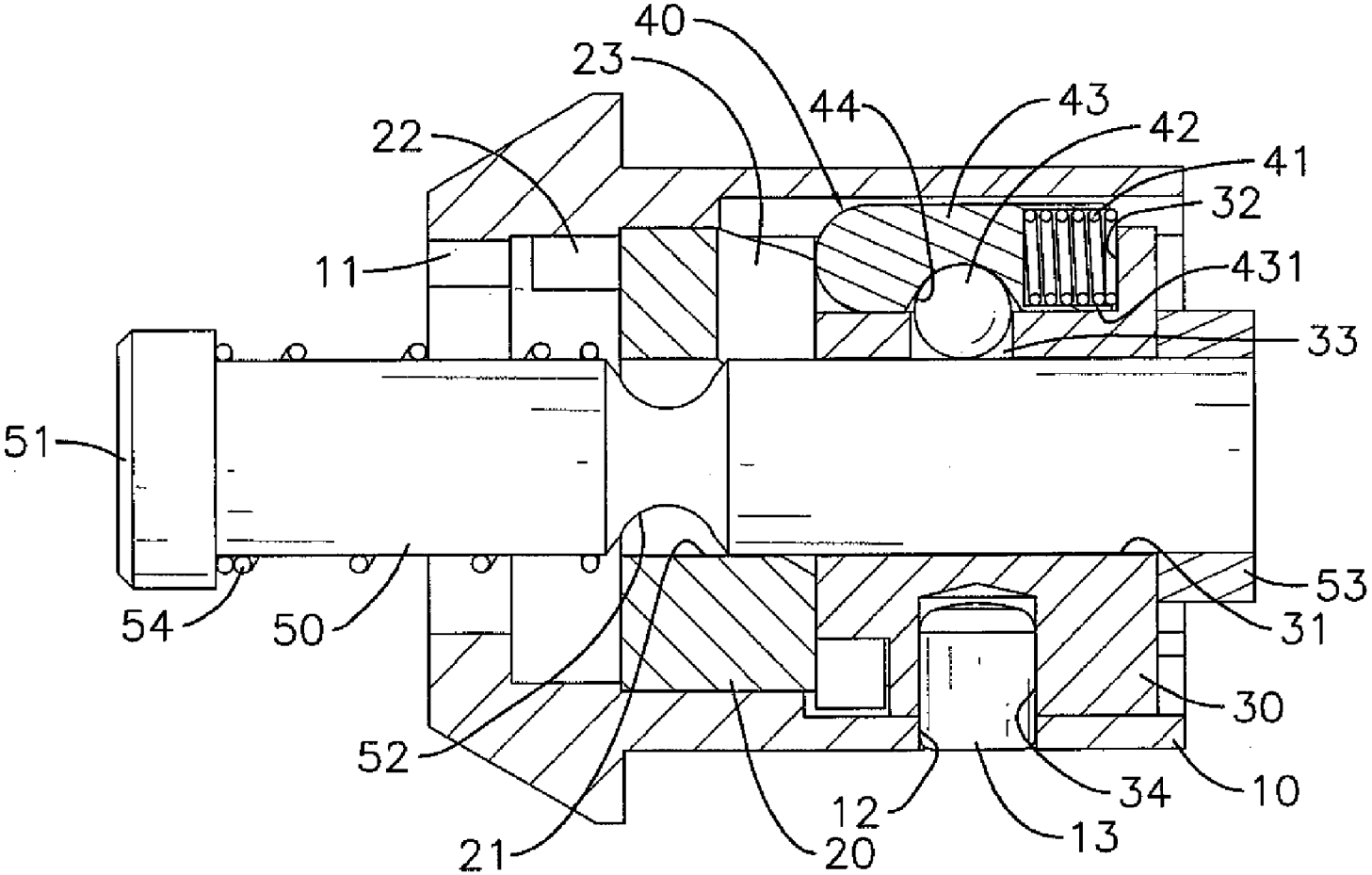
FIG. 5 is a side view in partial section of the lock in FIG. 4.

With further reference to FIGS. 4 and 5, the housing (10) is cylindrical and has a front open end, a rear open end, a cavity, an annular inside flange, an alignment slot (11), a mounting hole (12) and a retainer (13). The cavity communicates with the front and rear open ends, The annular inside flange radially extends inward from the front open end. The alignment slot (11) is defined radially in the annular inside flange and corresponds to the alignment projection (61) on the key (60). The mounting hole (12) is defined transversely through the housing (10) and communicates with the cavity. The retainer (13) is mounted through the mounting hole (12).

The movable cylinder (20) is mounted rotatably in the cavity in the housing (10) and has a front open end, a rear open end, a central hole (21), two protrusions (22), a gap, a curved recess (23), multiple outer tumbler holes (24) and multiple outer tumblers (25). The central hole (21) is defined through the movable cylinder (20) and communicates with the front and rear ends. The protrusions (22) extend outward from the front open end of the movable cylinder (20). The gap is defined between the protrusions (22) and is selectively aligned or misaligned with the alignment slot (11). The curved recess (23) is defined longitudinally in the rear open end of the movable cylinder (20). The outer tumbler holes (24) are defined longitudinally through the movable cylinder (20), are arranged in a circular arrangement around the central hole (21) and are aligned with the tumbler recesses (62) in the key (60). The outer tumblers (25) are slidably mounted respectively in the outer tumbler holes (24).

The stationary cylinder (30) is mounted in the cavity in the housing (10) adjacent to the rear open end of the movable cylinder (20) and has an axis, a front open end, a rear open end, a central hole (31), a rail slot (32), a through hole (33), a mounting hole (34), multiple inner tumbler holes (35), multiple inner tumblers (36) and multiple springs (37). The central hole (31) is defined through the stationary cylinder (30) along the axis. The rail slot (32) is defined longitudinally in the front open end of the stationary cylinder (30) along the axis, is selectively aligned or misaligned with the curved recess (23) in the movable cylinder (20) and has a bottom and a rear end. The through hole (33) is defined through the bottom of the rail slot (32) and communicates with the central hole (31) in the stationary cylinder (30). The mounting hole (34) is defined transversely in the stationary cylinders (30) and receives the retainer (13) in the housing (10) so the stationary cylinder (30) will not fall out of the housing (10) inadvertently. The inner tumbler holes (35) are defined longitudinally in the front open end, are arranged in a circular arrangement around the central hole (31) in the stationary cylinder (30) and are selectively aligned or misaligned with the outer tumbler holes (24) in the moveable cylinder (20). Each inner tumbler hole (35) has an inside closed end. The inner tumblers (36) are slidably mounted respectively in the inner tumbler holes (35) and respectively abut the outer tumblers (25) in the movable cylinder (20) when the inner tumbler holes (35) are aligned with the outer tumbler holes. The springs (37) are mounted respectively in the inner tumbler holes (35) between the inside closed end and the inner tumblers (36) and push the inner tumblers (36) to tightly abut the outer tumblers (25). Inserting the key (60) into the lock with the tumbler recesses (62) respectively receiving and pushing the outer tumblers (25) inward causes a boundary between the outer and inner tumblers (25, 36) to be aligned with a boundary between the movable and stationary cylinders (20, 30). The alignment of the boundaries allows the movable cylinder (20) to rotate with the key (60) relative to the stationary cylinder (30). Removing the key (60) from the lock causes the inner tumblers (36) pushed by the springs (37) in the inner tumbler holes (35) to move forward into the outer tumbler holes (24) in the movable cylinder (20) to prevent the movable cylinder (20) from rotating.

Figure 7:
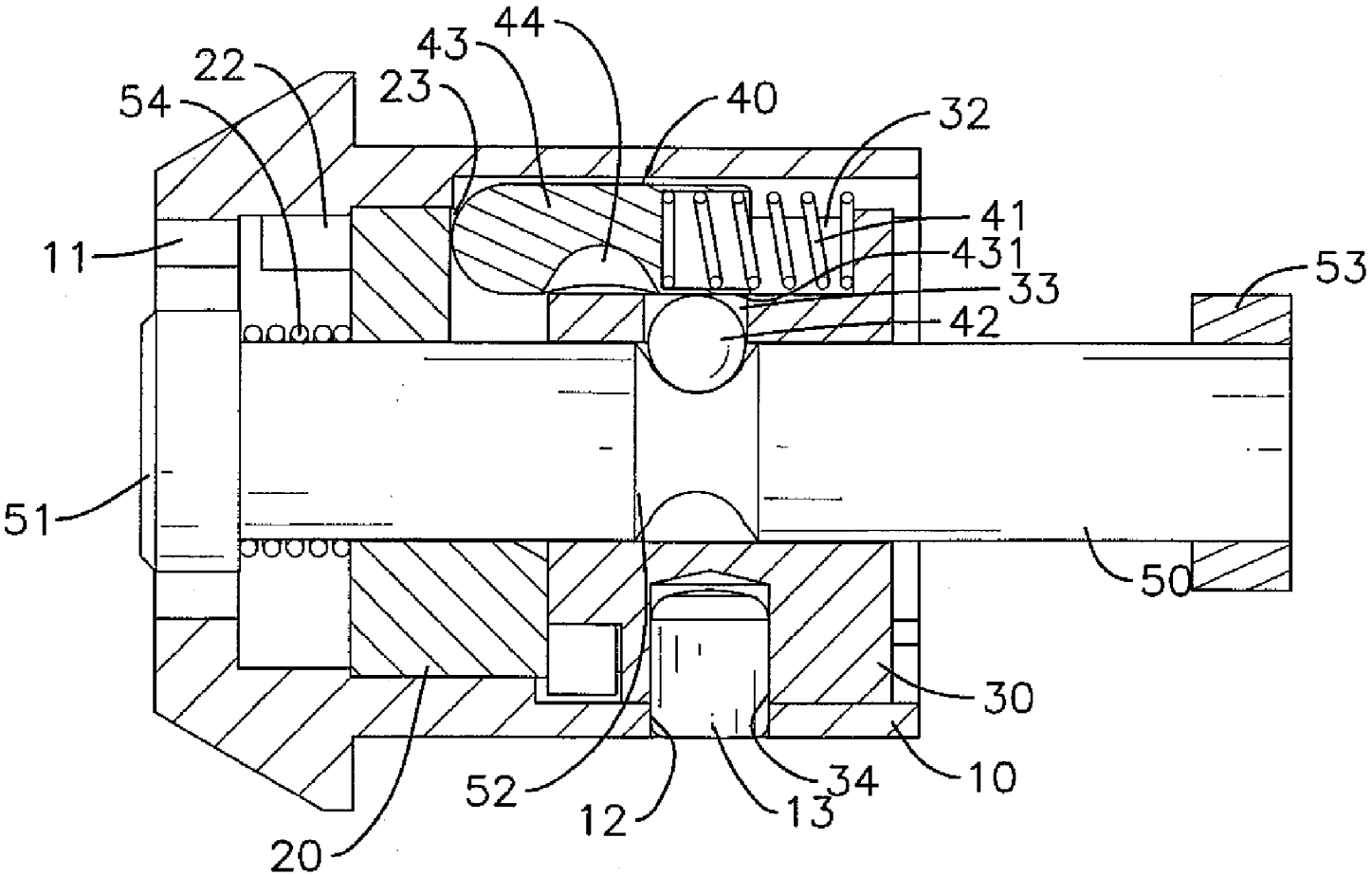
FIG. 7 is a side view in partial section of the lock in FIG. 6.

With reference to FIGS. 5 and 7, the limiting slide assembly (40) is mounted movably in the rail slot (32) to selectively hold the lock in the locked or unlocked configurations. The limiting slide assembly (40) has a limiting slide (43), a spring (41) and a ball (42). The limiting slide (43) is mounted slidably in the rail slot (32) in the stationary cylinder (30) and is capable of sliding along the axis of the stationary cylinder (30). The limiting slide (43) engages the curved recess (23) in the movable cylinder (20) and closes the through hole (33) of the stationary cylinder (30) when the lock is in the locked configuration. The Limiting slide (43) disengages from the curved recess (23) when the lock is in the unlocked configuration. The limiting slide (43) has a flat outside surface and a ball recess (44). The flat outside surface (431) selectively abuts and closes the through hole (33) of the stationary cylinder (30). The ball recess (44) is curved, is defined transversely in the limiting slide (43) and communicates with the through hole (33) in the stationary cylinder (30) when the lock is in the unlocked configuration. The spring (41) is mounted between the rear end of the rail slot (32) in the stationary cylinder (30) and the limiting slide (43). The ball (42) is mounted in the through hole (33) in the stationary cylinder (30) and engages the ball recess (44) in the limiting slide (43) when the lock is in the unlocked configuration. The ball (42) disengages from the ball recess (44) and abuts and is blocked by the flat outside surface (431) of the limiting slide (43) from moving outward from the through hole (33) of the stationary cylinder (30) when the lock is in the locked configuration.

Figure 8:
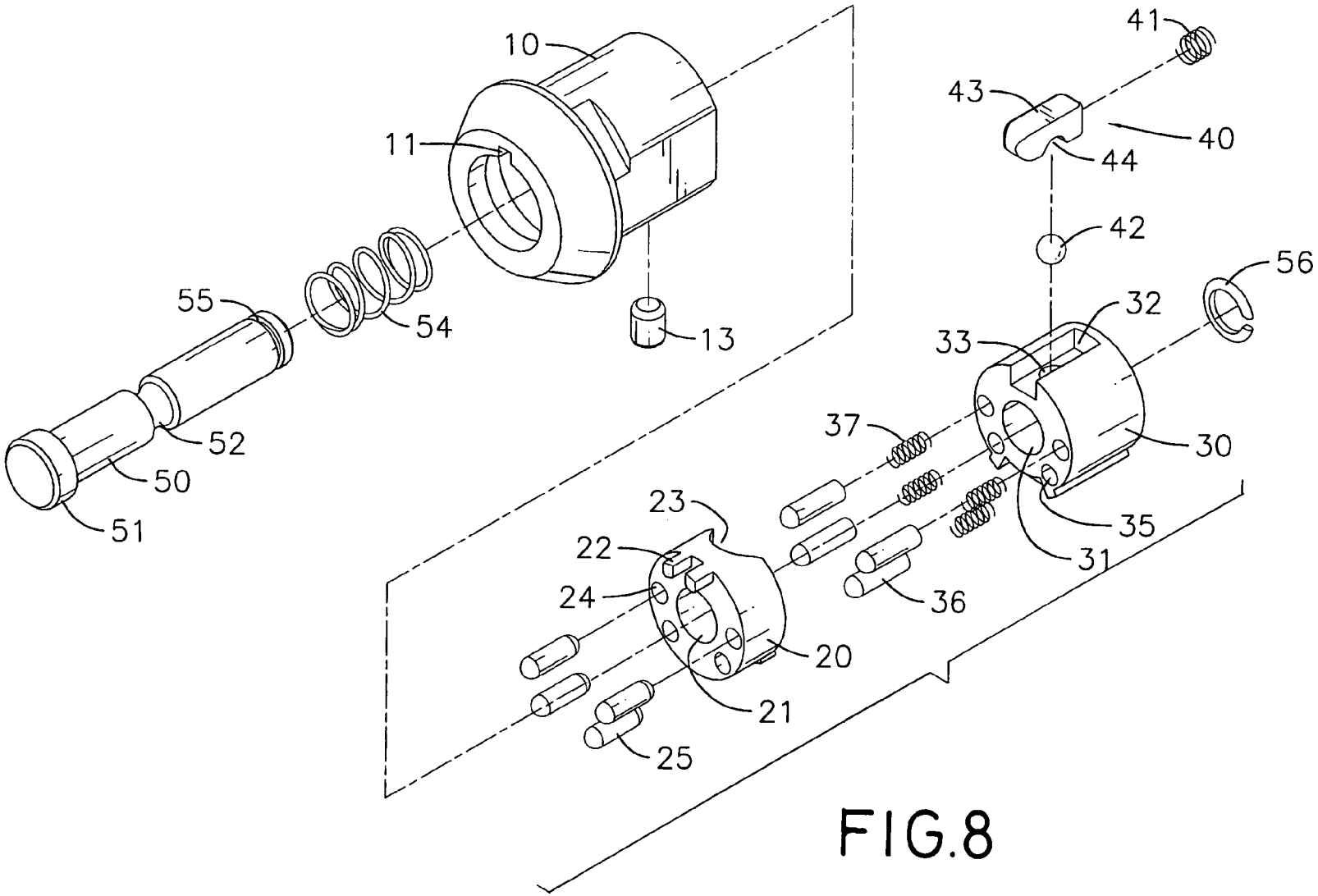
FIG. 8 is an exploded perspective view of a second embodiment of a lock in accordance with the present invention.
Figure 9:
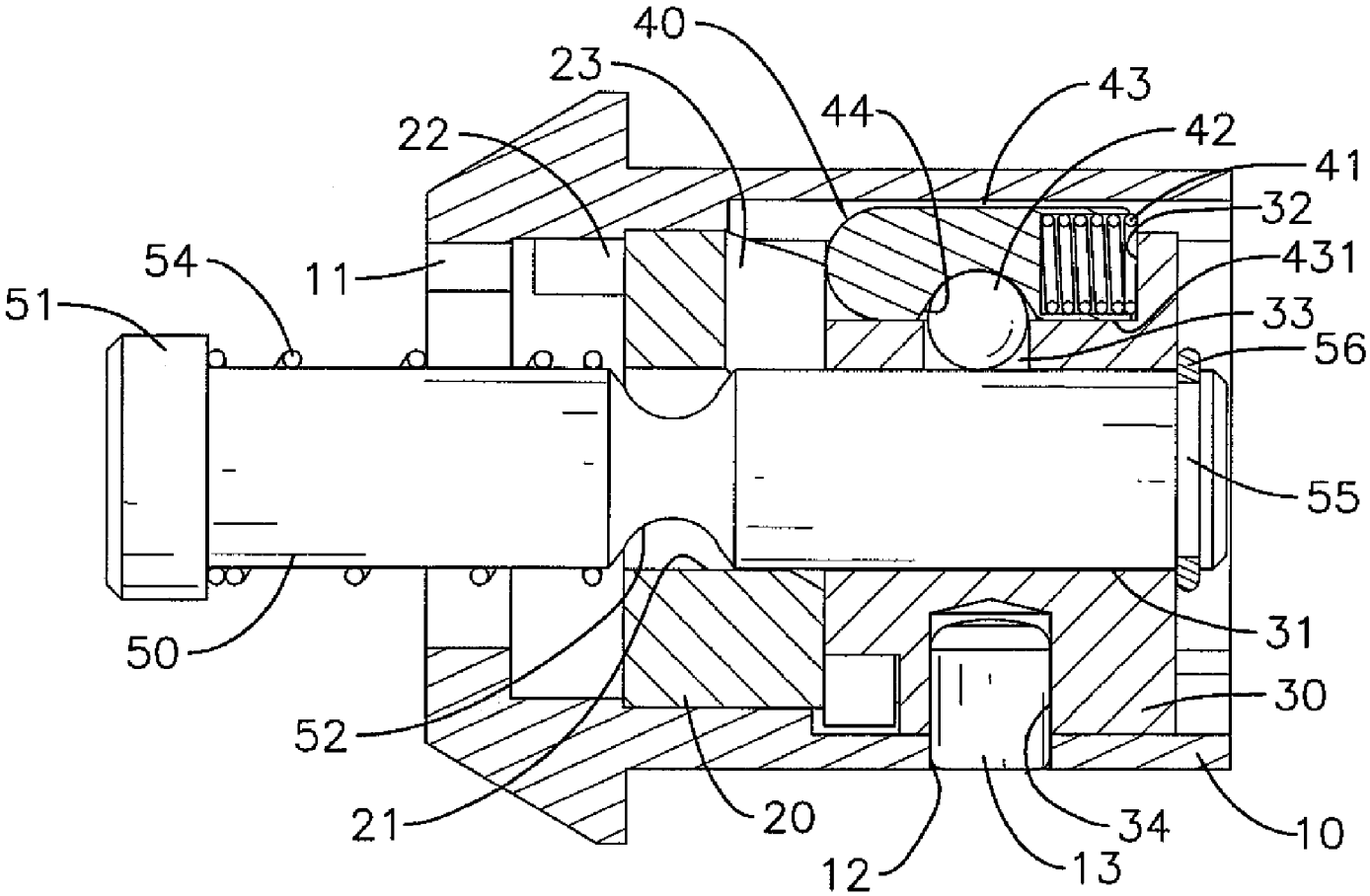
FIG. 9 is a side view in partial section of the lock in FIG. 8.

The latch bar (50) is individually formed from the stationary and moveable cylinders (30, 20). The latch bar slidably extends through central holes (21, 31) in the movable cylinder (20) and the stationary cylinder (30), is capable of sliding along the axis of the stationary cylinder (30) and has a front end, a rear end, an enlarged head (51), an annular groove (52), a spring (54) and a fastener. The enlarged head (51) is formed on the front end. The annular groove (52) is defined around the latch bar (50), is aligned with the through hole (33) in the stationary cylinder (30) and receives the ball (42) when the lock is in the locked configuration and the rear end of the latch bar (50) protrudes out of the housing (10). The spring (54) is mounted around the latch bar (50) between the enlarged head (51) and the front open end of the movable cylinder (20) to push the latch bar (50) forward. In a first embodiment of the lock, the fastener is an annular collar (53) securely mounted on the rear end of the latch bar (50) and abutting the rear open end of the stationary cylinder (30) to prevent the latch bar (50) from falling out of the housing (10), as shown in FIG. 1. With reference to FIGS. 8 and 9, a second embodiment of the lock has the latch bar (50) further having a fastener groove (55) defined radially around the rear end of the latch bar (50). The fastener is a C-shaped clasp (56) mounted in the fastener groove (55).

With reference to FIG. 5, when the lock is in the unlocked configuration, the front end of the latch bar (50) protrudes out of the housing (10). The ball (42) is mounted in the through hole (33) in the stationary cylinder (30) and the ball recess (44) in the limiting slide (43) and is rotatable relative to the latch bar (50).

Figure 6:
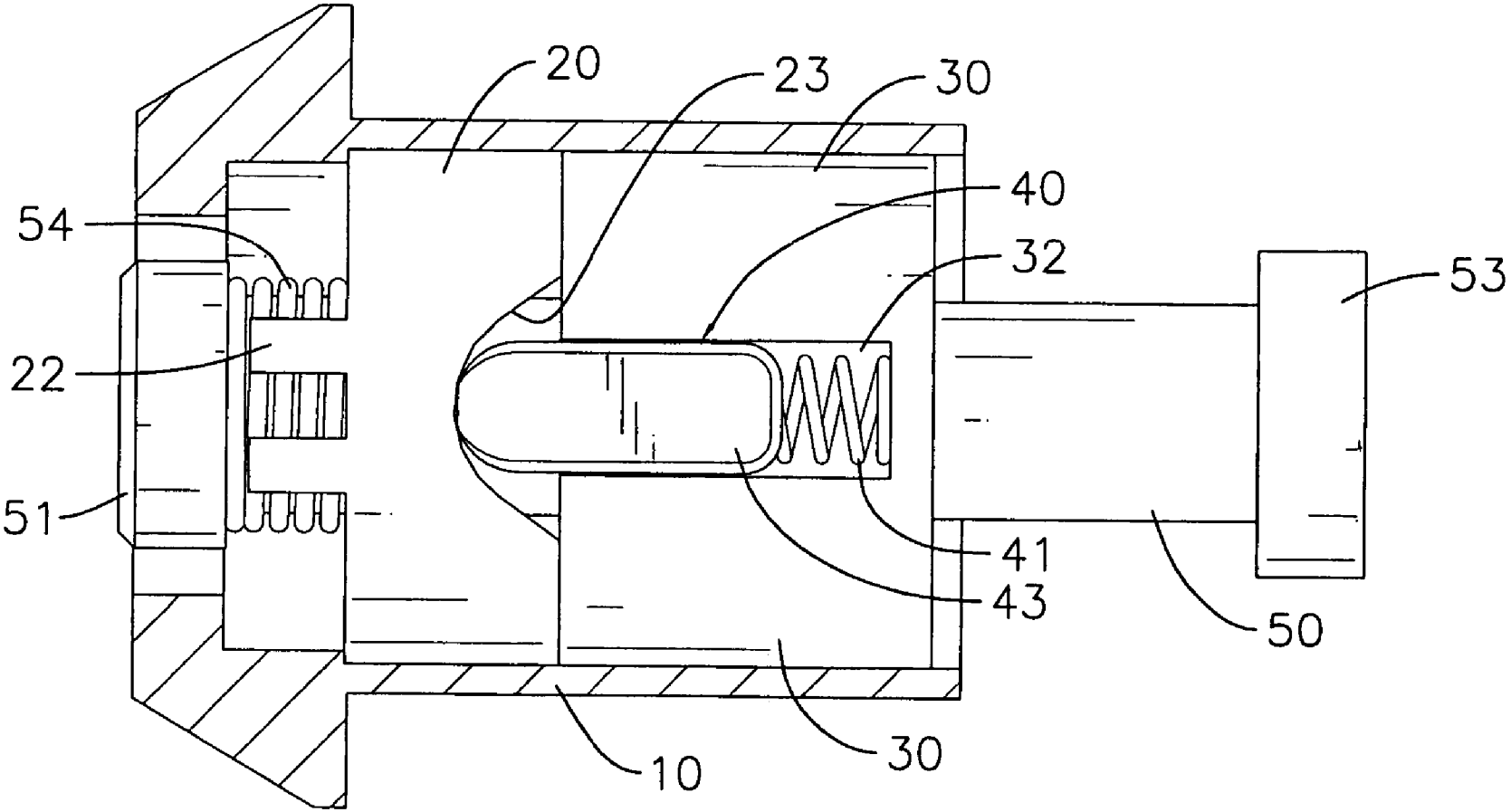
FIG. 6 is a top view in partial section of the lock in FIG. 3 in a locked configuration.

With reference to FIGS. 6 and 7, pushing the front end of the latch bar (10) into the housing (10) causes the rear end to protrude out of the housing (10) and extend into an article such as a door frame or a body of a safe and changes the lock into the locked configuration. Simultaneously, the annular groove (52) moves to be aligned with the through hole (33) in the stationary cylinder (30). The ball (42) engages the annular groove (52) and disengages from the ball recess (44) in the limiting slide (43) so the limiting slide (43) is pushed by the spring (41) in the rail slot (32) and slides forward to engage the curved recess in the movable cylinder (20) and close the through hole (33) in the stationary cylinder (30). The closed through hole (33) prevents the ball (42) from disengaging from the annular groove (52) in the latch bar (50) so any unauthorized attempts to unlock the lock without the key (60) cannot move the latch bar (50).

To open the lock, the key (60) is inserted into the front open end of the housing (10) with the alignment projection (61) engaging the gap between the protrusions (22) on the movable cylinder (20). Rotating the key (60) causes the movable cylinder (20) to rotate relative to the stationary cylinder (30). The limiting slide (43) slips out of and disengages from the curved recess (23) misaligned with the rail slot (32), and the ball recess (44) is aligned with the through hole (33). Then, the ball (42) slips out of and disengages from the annular groove (52) and engages the ball recess (44) again when the latch bar (50) moves forward with the recovering force of the spring (54) around the latch bar (50).

The limiting slide assembly (40) in the rail slot (32) is compact, has a simple structure and can be fabricated easily. Therefore, the production rate of the lock is improved, and the cost of the lock is lowered.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A lock comprising:

a housing having a front open end, a rear open end and a cavity communicating with the front and rear open ends;

a movable cylinder rotatably mounted in the cavity in the housing and having a front open end, a rear open end, a central hole defined through the movable cylinder and communicating with the front and rear ends of the movable cylinder, two protrusions extending outward from the front open end of the movable cylinder, a gap defined between the protrusions, a curved recess defined in the rear open end of the movable cylinder, multiple outer tumbler holes defined through the movable cylinder and multiple outer tumblers slidably mounted respectively in the outer tumbler holes;

a stationary cylinder mounted in the cavity in the housing adjacent to the rear open end of the movable cylinder and having an axis;

a front open end;

a rear open end;

a central hole defined through the stationary cylinder along the axis;

a rail slot defined longitudinally in the front open end of the stationary cylinder along the axis, corresponding to the curved recess in the movable cylinder and having a bottom and a rear end;

a through hole defined through the bottom of the rail slot and communicating with the central hole in the stationary cylinder;

multiple inner tumbler holes defined in the front open end and corresponding to the outer tumbler holes in the moveable cylinder and each inner tumbler hole having an inside closed end;

multiple inner tumblers slidably mounted respectively in the inner tumbler holes, respectively abutting the outer tumblers in the movable cylinder when the inner tumbler holes are aligned with the outer tumbler holes; and multiple springs mounted respectively in the inner tumbler holes and each spring located between the inside closed end of a corresponding inner tumbler hole and the inner tumbler inside the corresponding inner tumbler hole;

a limiting slide assembly mounted movably in the rail slot to selectively hold the lock in a locked configuration or an unlocked configuration and having a limiting slide mounted slidably in the rail slot in the stationary cylinder, capable of sliding along the axis of the stationary cylinder, engaging the curved recess in the movable cylinder and closing the through hole of the stationary cylinder when the lock is in the locked configuration and disengaging from the curved recess when the lock is in the unlocked configuration and having a flat outside surface located on the limiting slide and selectively abutting and closing the through hole of the stationary cylinder; and a ball recess being curved, defined in the limiting slide and communicating with the through hole in the stationary cylinder when the lock is in the unlocked configuration;

a spring mounted between the rear end of the rail slot in the stationary cylinder and the limiting slide; and a ball mounted in the through hole in the stationary cylinder, engaging the ball recess in the limiting slide when the lock is in the unlocked configuration and disengaging from the ball recess and abutting and blocked by the flat outside surface of the limiting slide from moving outward from the through hole of the stationary cylinder when the lock is in the locked configuration; and a latch bar being individual from the stationary and movable cylinders, slidably extending through central holes in the movable and stationary cylinders, capable of sliding along the axis of the stationary cylinder and having a front end, a rear end, an enlarged head formed on the front end, an annular groove defined around the latch bar, a spring mounted around the latch bar between the enlarged head and the front open end of the movable cylinder and a fastener mounted to the latch bar to prevent the latch bar from falling out of the housing.

2. The lock as claimed in claim 1, wherein the fastener is an annular collar securely mounted to the rear end of the latch bar.

3. The lock as claimed in claim 1, wherein:

the latch bar further has a fastener groove defined radially around the rear end of the latch bar and the fastener is a C-shaped clasp mounted in the fastener groove.

4. The lock as claimed in claim 1, wherein:

the stationary cylinder further has a mounting hole defined transversely in the stationary cylinder; and the housing further has a mounting hole defined transversely through the housing and communicating with the cavity and a retainer mounted through the mounting holes in the housing and the stationary cylinder.

5. The lock as claimed in claim 1, wherein:

the housing further has an annular inside flange radially extending inward from the front open end of the housing and an alignment slot defined radially in the annular inside flange and aligned with the gap in the movable cylinder.

* * * * *